US007156062B2

(12) United States Patent
Vanderpoel

(10) Patent No.: US 7,156,062 B2
(45) Date of Patent: Jan. 2, 2007

(54) VALVE ACTUATION SYSTEM WITH VALVE SEATING CONTROL

(75) Inventor: Richard Vanderpoel, Bloomfield, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 10/826,404

(22) Filed: Apr. 19, 2004

(65) Prior Publication Data

US 2005/0229888 A1 Oct. 20, 2005

(51) Int. Cl.
*F01L 1/14* (2006.01)

(52) U.S. Cl. ..... 123/90.59; 123/90.43; 123/90.39; 123/90.45

(58) Field of Classification Search ..... 123/90.59, 123/90.43, 90.39, 90.45
See application file for complete search history.

(56) References Cited

U.S. PATENT DOCUMENTS 5,960,756 A * 10/1999 Miyachi et al. ..... 123/90.16
2004/0065285 A1* 4/2004 Uludogan et al. ..... 123/90.59

* cited by examiner

*Primary Examiner*—Thomas Denion
*Assistant Examiner*—Zelalem Eshete
(74) *Attorney, Agent, or Firm*—David R. Yohanan, Esq.; Kelley Drye & Warren, LLP

(57) ABSTRACT

A variable valve actuation system to actuate and control the seating velocity of an internal combustion engine valve is disclosed. The system comprises: a housing; a lost motion system disposed in the housing; a rocker arm having a first contact surface, a second contact surface, and a third contact surface, the first contact surface operatively contacting the engine valve, and the second contact surface operatively contacting the lost motion system; and a valve seating device disposed in the housing, operatively contacting the third contact surface.

19 Claims, 6 Drawing Sheets

VALVE ACTUATION SYSTEM WITH VALVE SEATING CONTROL

FIELD OF THE INVENTION

The present invention relates generally to systems and methods for controlling engine combustion chamber valves in an internal combustion engine. In particular, the present invention relates to systems and methods for actuating one or more engine valves with valve seating control.

BACKGROUND OF THE INVENTION

Engine combustion chamber valves, such as intake and exhaust valves, are typically spring biased toward a valve closed position. In many internal combustion engines, the engine valves may be opened and closed by fixed profile cams in the engine. More specifically, valves may be opened or closed by one or more fixed lobes which may be an integral part of each of the cams. In some cases, the use of fixed profile cams may make it difficult to adjust the timings and/or amounts of engine valve lift. It may be desirable, however, to adjust valve opening times and lift for various engine operating conditions, such as different engine speeds.

A method of adjusting valve timing and lift, given a fixed cam profile, has been to incorporate a "lost motion" device in the valve train linkage between the valve and the cam. Lost motion is the term applied to a class of technical solutions for modifying the valve motion dictated by a cam profile with a variable length mechanical, hydraulic, or other linkage means. The lost motion system comprises a variable length device included in the valve train linkage between the cam and the engine valve. The lobe(s) on the cam may provide the "maximum" (longest dwell and greatest lift) motion needed for a range of engine operating conditions. When expanded fully, the variable length device (or lost motion system) may transmit all of the cam motion to the valve, and when contracted fully, transmit none or a reduced amount of cam motion to the valve. By selectively decreasing the length of the lost motion system, part or all of the motion imparted by the cam to the valve can be effectively subtracted or lost.

Hydraulic-based lost motion systems may provide a variable length device through use of a hydraulically extendable and retractable piston assembly. The length of the device is shortened when the piston is retracted into its hydraulic chamber, and the length of the device is increased when the piston is extended out of the hydraulic chamber. One or more hydraulic fluid control valves may be used to control the flow of hydraulic fluid into and out of the hydraulic chamber.

One type of lost motion system, known as a Variable Valve Actuation (VVA) system, may provide multiple levels of lost motion. Hydraulic VVA systems may employ a high-speed control valve to rapidly change the amount of hydraulic fluid in the chamber housing the hydraulic lost motion piston. The control valve may also be capable of providing more than two levels of hydraulic fluid in the chamber, thereby allowing the lost motion system to attain multiple lengths and provide variable levels of valve actuation.

Typically, engine valves are required to open and close very quickly, and therefore the valve return springs are generally relatively stiff. If left unchecked after a valve opening event, the valve return spring could cause the valve to impact its seat with sufficient force to cause damage to the valve and/or its seat. In valve actuation systems that use a valve lifter to follow a cam profile, the cam profile provides built-in valve closing velocity control. The cam profile may be formed so that the actuation lobe merges gently with cam base circle, which acts to decelerate the engine valve as it approaches its seat.

In hydraulic lost motion systems, and in particular VVA hydraulic lost motion systems, rapid draining of fluid from the hydraulic circuit may prevent the valve from experiencing the valve seating provided by cam profile. In VVA systems, for example, an engine valve may be closed at an earlier time than that provided by the cam profile by rapidly releasing hydraulic fluid from the lost motion system. When fluid is released from the lost motion system, the valve return spring may cause the engine valve to "free fall" and impact the valve seat at an unacceptably high velocity. The valve may impact the valve seat with such force that it eventually erodes the valve or valve seat, or even cracks or breaks the valve. In such instances, engine valve seating control may be desired because the closing velocity of the valve is governed by the release of hydraulic fluid from the lost motion system instead of by a fixed cam profile. Accordingly, there is a need for valve seating devices in engines that include lost motion systems, and most notably in VVA lost motion systems.

In order to avoid a damaging impact between the engine valve and its seat, the valve seating device should oppose the closing motion regardless of the position of other valve train elements. In order to achieve this goal, the point at which the engine valve experiences valve seating control should be relatively constant. In other words, the point during the travel of the engine valve at which the valve seating device actively opposes the closing motion of the valve should be relatively constant for all engine operating conditions. Accordingly, it may be advantageous to position the valve seating device such that it can oppose the closing motion of the engine valve without regard to the position of intervening valve train elements, such as rocker arms, push tubes, or the like.

The valve seating device may include hydraulic elements, and thus may need to be supported in a housing and require a supply of hydraulic fluid, yet at the same time fit within the packaging limits of a particular engine. It may also be advantageous to locate the valve seating device near other hydraulic lost motion components. By locating the valve seating device near other lost motion components, housings, hydraulic feeds, and/or accumulators may be shared, thereby reducing bulk and the number of required components.

A valve seating device may be constructed so that a significant portion of the opposing force it applies to a closing engine valve occurs during the last millimeter of travel of the valve. As a result, control of the amount of lash space between the valve seating device and the engine valve or other intervening elements may be critical to proper operation of the valve seating device. Factors such as component thermal growth, valve wear, valve seat wear, and tolerance stack-up can affect the amount of lash. Some known valve seating devices have required manual lash adjustment or a separate set of lash adjustment hardware. Accordingly, it may be advantageous to have a valve seating device that self-adjusts for lash differences between the engine valve and the valve seating device.

Various embodiments of the present invention may meet one or more of the aforementioned needs and provide other benefits as well.

SUMMARY OF THE INVENTION

Applicant has developed an innovative valve actuation system having valve seating control. In one embodiment, the system comprises: a housing; a lost motion system disposed in the housing; a rocker arm having a first contact surface, a second contact surface, and a third contact surface, the first contact surface operatively contacting the engine valve, and the second contact surface operatively contacting the lost motion system; and a valve seating device disposed in the housing, operatively contacting the third contact surface.

Applicant has further developed an innovative system for controlling the seating velocity of an engine valve in an internal combustion engine. In one embodiment, the system comprises: a housing; a lash piston slidably disposed in a bore formed in the housing, the lash piston having a cavity formed therein; and a seating piston slidably disposed in the cavity.

It is to be understood that both the foregoing general description and the following detailed description are exemplary and explanatory only, and are not restrictive of the invention as claimed. The accompanying drawings, which are incorporated herein by reference, and which constitute a part of specification, illustrate certain embodiments of the invention and, together with the detailed description, serve to explain the principles of the present invention.

BRIEF DESCRIPTION OF THE DRAWINGS

In order to assist in the understanding of the invention, reference will now be made to the appended drawings, in which like reference characters refer to like elements. The drawings are exemplary only, and should not be construed as limiting the invention.

DETAILED DESCRIPTION OF PREFERRED EMBODIMENTS OF THE INVENTION

Figure 1:
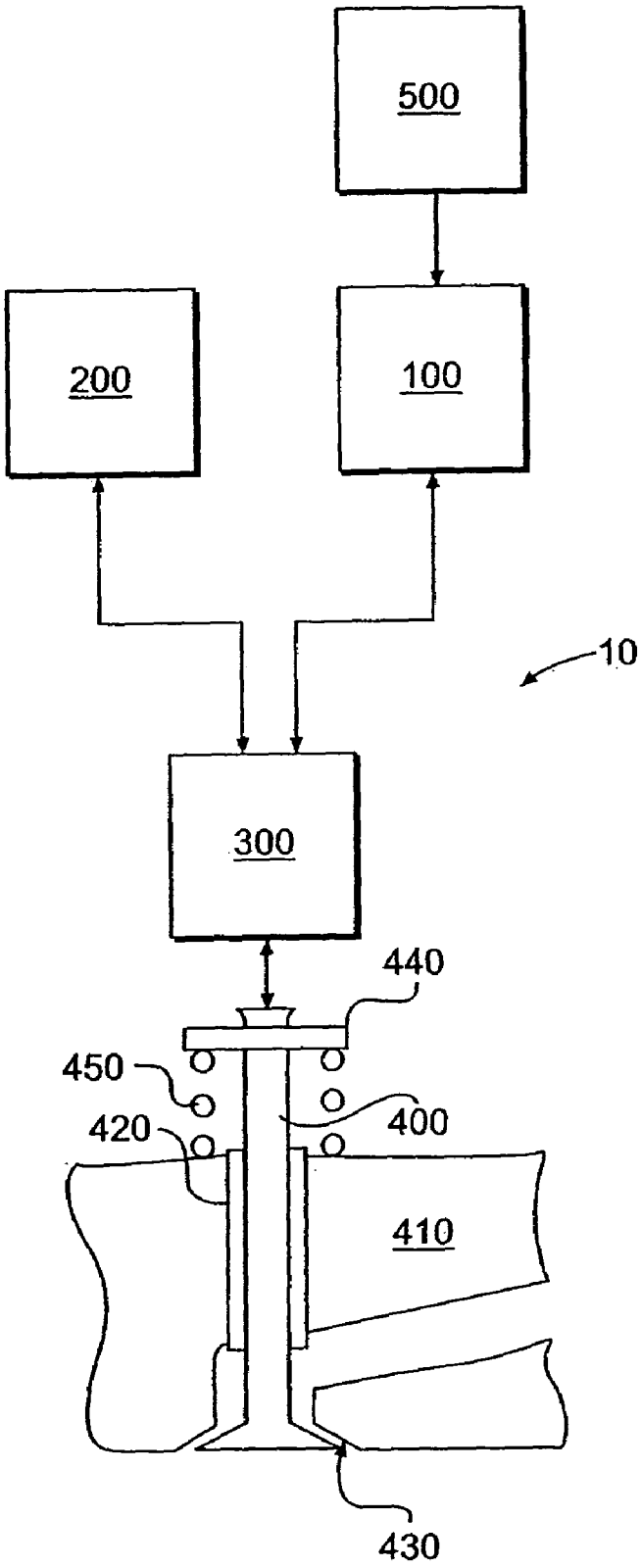
FIG. 1 is a schematic diagram of a valve seating control system in accordance with a first embodiment of the present invention.

Reference will now be made in detail to a first embodiment of a valve seating control system 10 of the present invention, an example of which is illustrated in FIG. 1. The system 10 may include one or more valve train elements 300 operatively connected to a lost motion system 100, a valve seating device 200, and at least one engine valve 400. The lost motion system 100 may receive an input from a motion imparting means 500. The valve train element 300 may transmit a valve actuation motion to the engine valve 400. The engine valve 400 may be actuated to produce various engine valve events, such as, but not limited to, main intake, main exhaust, compression release braking, bleeder braking, exhaust gas recirculation, early exhaust valve opening and/or closing, early intake opening and/or closing, centered lift, etc. The engine valve 400 may comprise an exhaust valve, intake valve, or auxiliary valve.

The motion imparting means 500 may comprise any combination of cam(s), push-tube(s), rocker arm(s) or other mechanical, electromechanical, hydraulic, or pneumatic device for imparting a linear actuation motion. The motion imparting means 500 may receive motion from an engine component and transfer the motion as an input to the lost motion system 100.

The lost motion system 100 may comprise any structure that connects the motion imparting means 500 to the valve train element 300 and which is capable of selectively losing part or all of the motion imparted to it by the motion imparting means 500. The lost motion system 100 may comprise, for example, a variable length mechanical linkage, hydraulic circuit, hydro-mechanical linkage, electromechanical linkage, and/or any other linkage provided between the motion imparting means 500 and the valve train element 300 and adapted to attain more than one operative length. If the lost motion system 100 incorporates a hydraulic circuit, it may include means for adjusting the pressure or the amount of fluid in the hydraulic circuit, such as, for example, trigger valve(s), check valve(s), accumulator(s), and/or other devices used to release hydraulic fluid from, or add hydraulic fluid to, a hydraulic circuit.

The engine valve 400 may be disposed within a sleeve 420, which in turn is provided in a cylinder head 410. The engine valve 400 may be adapted to slide up and down relative to the sleeve 420 and may be biased into a closed position by a valve spring 450. The valve spring 450 may be compressed between the cylinder head 410 and a valve spring retainer 440 that may be attached to the end of a valve stem, thereby biasing the engine valve 400 into an engine valve seat 430. When the engine valve 400 is in contact with the engine valve seat 430, the engine valve 400 is effectively in a closed position.

The one or more valve train elements 300 may receive a force from the lost motion system 100 and may transfer this force to the engine valve 400. The one or more valve train elements 300 may also transmit the force of the valve spring 450 that biases the engine valve 400 into a closed position back to the lost motion system 100 and/or the valve seating device 200.

The valve seating device 200 is operatively connected to the valve train element 300. When the valve seating device 200 is activated, it may provide a resistance to the bias of the engine valve spring 450 through the valve train element 300. In a preferred embodiment, the valve seating device 200 is constantly activated. It is contemplated, however, that the valve seating device 200 may be deactivated when a user desires, so that it does not operate to seat the engine valve 400. When the valve seating device 200 is deactivated, the engine valve 400 may seat under the bias of the engine valve spring 450 and/or the lost motion device 100.

Under either a positive power engine mode or when the lost motion system 100 is not activated to lose motion, motion may be transferred from the motion imparting means 500 to the engine valve 400 through the valve train element 300. Likewise, the force of the engine valve spring 450 may be transferred from the engine valve spring 450, through the valve train element 300, and to the lost motion system 100 and/or the valve seating device 200. However, when the lost motion system 100 acts to lose the motion of the motion imparting means 500, the engine valve 400 normally may close in a "free-fall," a state in which the engine valve 400 may contact the engine valve seat 430 at an undesirably high rate of speed. In order to slow the velocity at which the engine valve 400 closes when the lost motion system 100 is losing motion, the valve seating device 200 may be used.

The valve seating device 200 may slow the speed at which the engine valve 400 contacts the engine valve seat 430 by opposing the motion of the engine valve 400 through the valve train element 300. The valve seating device 200 may slow the seating velocity of the engine valve 400, preferably in a progressive manner, and particularly in the last millimeter of travel, thereby reducing the wear and damage on both the engine valve 400 and the engine valve seat 430.

Figure 2:
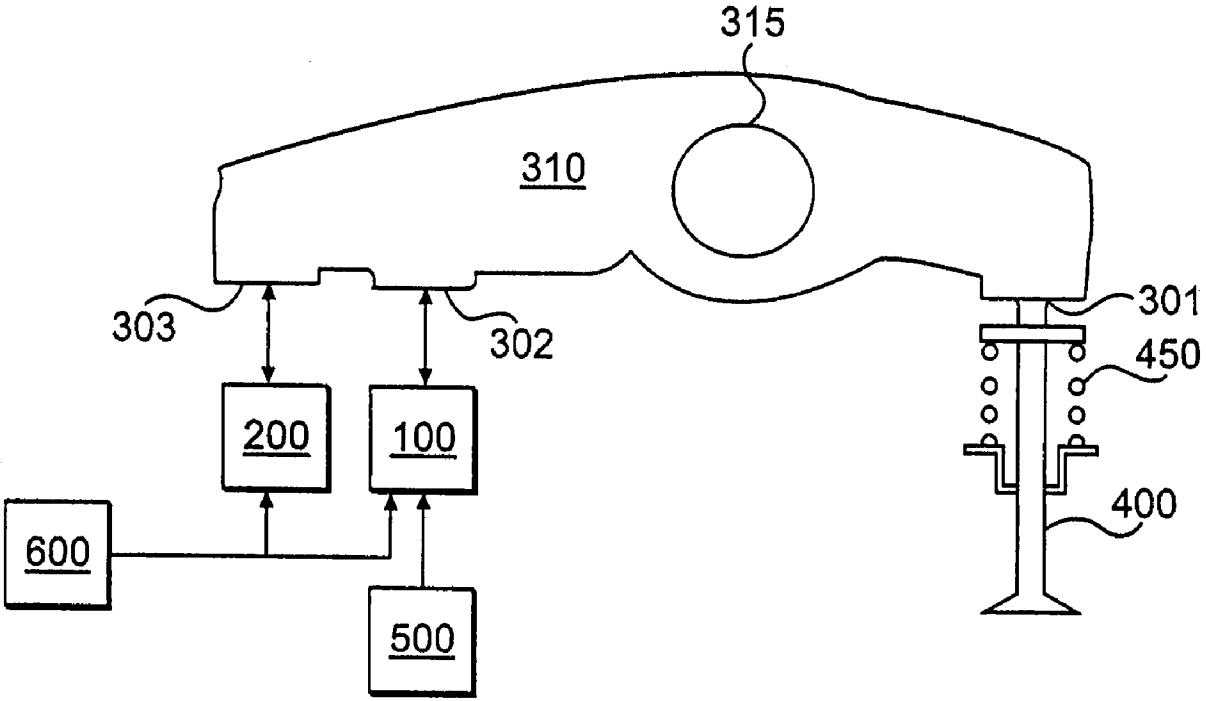
FIG. 2 is a schematic diagram of a valve seating control system in accordance with a second embodiment of the present invention.

A second embodiment of the present invention is illustrated in FIG. 2, in which like reference characters refer to like elements. With reference thereto, the valve train element 300 may comprise a rocker arm 310. The rocker arm 310 may be disposed pivotally on a shaft 315, and may include a first contact surface 301 for operatively contacting the engine valve 400, a second contact surface 302 for operatively contacting the lost motion system 100, and a third contact surface 303 for operatively contacting the valve seating device 200. The rocker arm 310 may pivot about the shaft 315 so as to transmit motion from one side of the pivot point to the other. In this manner, the rocker arm 310 may receive input motion from the lost motion system 100 and/or the valve seating device 200 and may transmit this motion to the engine valve 400. The rocker arm 310 may also transmit motion from the engine valve 400 to the lost motion system 100 and/or to the valve seating device 200 in a similar manner.

The third contact surface 303 may be situated such that the point during the travel of the engine valve at which the valve seating device actively opposes the closing motion of the valve is relatively constant for all engine operating conditions. As shown in FIG. 2, the second contact surface 302 may be located between the first contact surface 301 and the third contact surface 303. However, it is appreciated that the third contact surface 303 may be located at any point on the rocker arm 310 that has a unique position when the engine valve 400 is in a closed position.

In one embodiment of the present invention, as shown in FIG. 2, the system 10 may further comprise a control circuit 600. The control circuit 600 may provide the lost motion system 100 and the valve seating device 200 with control inputs for activating and/or deactivating the lost motion system 100 and the valve seating device 200. The control inputs may be hydraulic fluid, electric signals, mechanical actuations, pneumatic actuations, electromechanical actuations, hydro-mechanical actuations, and/or any other suitable input for controlling operation of the systems.

In one embodiment of the present invention, the control circuit 600 may comprise a hydraulic fluid supply circuit. The control circuit 600 may supply constant fluid pressure to the valve seating device 200 such that it is activated and may actuate to slow the seating velocity of the engine valve 400. Depending on the engine operating mode, the control circuit 600 may selectively activate the lost motion system 100. When the lost motion system 100 is activated, it may lose all or part of the motion received from the motion imparting means 500, and thus may not supply motion to the rocker arm 310 and therefore to the engine valve 400.

Figure 3:
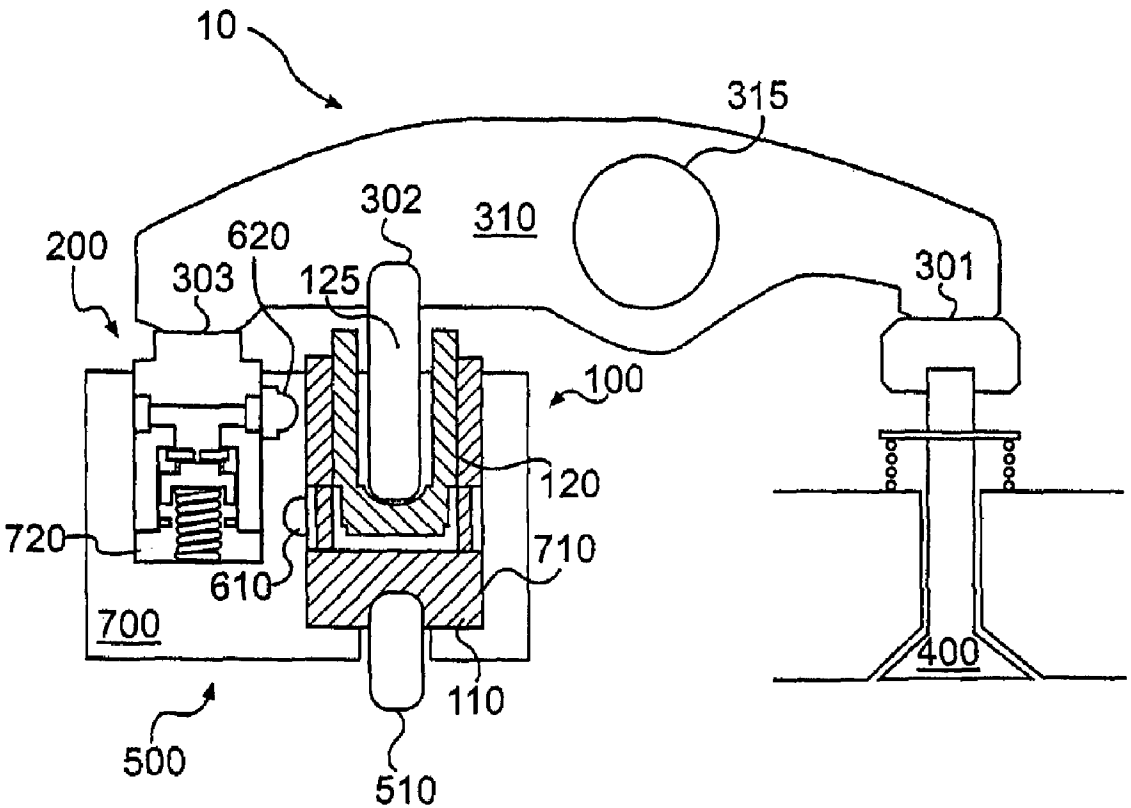
FIG. 3 is a cross-section of a valve seating control system in accordance with a third embodiment of the present invention.

A third embodiment of the present invention is illustrated in FIG. 3, in which like reference characters refer to like elements. The lost motion system 100 and the valve seating device 200 may be disposed in a housing 700. In one embodiment, the lost motion system 100 may comprise a collapsible tappet assembly having a master piston 110 and a slave piston 120. The master piston 110 may be slidably disposed in a bore 710 formed in the housing 700 such that it may slide back and forth in the bore 710 while maintaining a hydraulic seal with the housing 700. The slave piston 120 may be slidably disposed within the master piston 110 such that it may slide relative to the bore 710 while maintaining a hydraulic seal with the master piston 110. Hydraulic fluid may be selectively supplied to the lost motion system 100 between master piston 110 and the slave piston 120 through a passage 610.

In one embodiment of the present invention, as shown in FIG. 3, the slave piston 120 may further include an extension 125 having a first end contacting the slave piston 120 and a second end contacting the second contact surface 302 of the rocker arm 310. Alternatively, it is contemplated that the slave piston 120 may contact the rocker arm 310 directly. Other suitable means for supplying motion to the rocker arm 310 through the lost motion system 100 are considered well within the scope and spirit of the present invention.

In the embodiment of the present invention shown in FIG. 3, the motion imparting means 500 includes a push tube assembly 510. The push tube assembly 510 may contact and impart motion to one end of the master piston 110. The push tube 510 may receive engine valve actuation motion from one or more cams (not shown). In an alternative embodiment, the cam may act directly on the master piston 110 without the push tube 510.

A control circuit 600 element, such as, for example, a trigger valve (not shown) may be disposed in the passage 610. When motion transfer is required, the trigger valve may be closed such that fluid is trapped between the master piston 110 and the slave piston 120, creating a hydraulic lock. Motion from the pushtube 510 is transmitted through the master piston 110 and the slave piston 120 to the rocker arm 310, which, in turn, causes the engine valve 400 to open. When motion transfer is not required, the trigger valve is opened and fluid is permitted to flow in and out of the space between the master piston 110 and the slave piston 120. All, or a portion of, the motion applied to the master piston 110 is then "lost."

Figure 4:
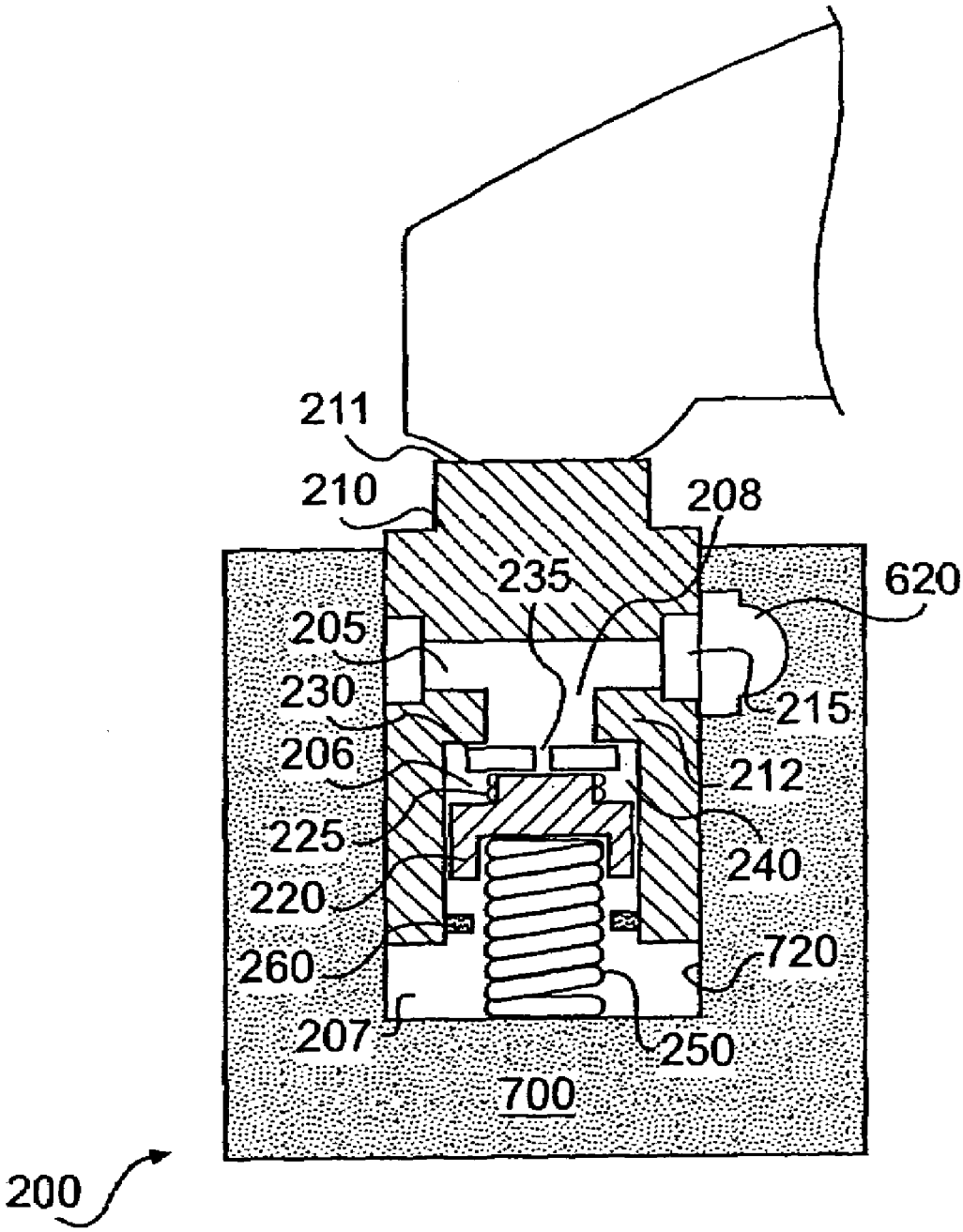
FIG. 4 is a cross-section detail view of a valve seating device in accordance with an embodiment of the present invention.

FIG. 4 is a cross-section of the valve seating device 200 in accordance with an embodiment of the present invention. The valve seating device 200 may comprise a lash piston 210 slidably disposed in a second bore 720 formed in the housing 700, and a seating piston 220 slidably disposed within a cavity 206 formed in the lash piston 210. The lash piston 210 may be adapted to slide relative to the bore 720 while at the same time maintaining a seal with the bore 720. The seating piston 220 may be adapted to slide within the cavity 206 while maintaining a seal with the lash piston 210.

A spring 250 having a first end in contact with the housing 700 and a second end in contact with the seating piston 220 biases the seating piston 220 in an upward direction relative to the bore 720. Downward translation of the seating piston 220 within the cavity 206 may be limited by a retaining ring 260 formed in the lash piston 210.

In one embodiment of the present invention, a check disk 230 may be disposed between the lash piston 210 and a piston head 225 extending from the seating piston 220. A fluid slot 205 and a fluid opening 208 may be formed within the lash piston 210 above the check disk 230. A spring 240 having a first end in contact with the seating piston 220 and a second end in contact with the check disk 230 biases the check disk 230 away from the piston head 225 against a shoulder 212 formed in the lash piston 210. In this position, the check disk may substantially cover the fluid opening 208.

Hydraulic fluid supply may communicate to the valve seating device 200 through a hydraulic passage 620 formed in the housing 700. The hydraulic passage 620 may terminate at the bore 720, and may communicate fluid to the fluid slot 205 through an annulus 215 formed in the lash piston 210. During operation, fluid may communicate between the cavity 206 and the hydraulic passage 620 through a bleed orifice 235 formed in the check disk 230, and the fluid opening 208 and the fluid slot 205.

It is appreciated that some fluid supplied through the passage 620 may leak past the seal formed between the lash piston 210 and the housing 700 into a lash chamber 207 below the lash piston 210. The pressure created by the fluid in the lash chamber 207 may cause the lash piston 210 to rise within the bore 720. This may cause the upper surface 211 of the lash piston 210 to contact the third contact surface 303 of the rocker arm 310, taking up any lash that may exist between the valve seating device 200 and the rocker arm 310.

Operation of the system 10 will now be described with reference to FIGS. 3 and 4. When motion transfer is required, hydraulic fluid is supplied to the lost motion system 100 through the passage 610. The fluid may fill the space between the master piston 110 and the slave piston 120. The control circuit 600 may close the trigger valve (not shown) disposed in the passage 610, preventing the fluid from flowing out of the lost motion system 100 and creating a hydraulic lock. As a result, the motion imparted to the master piston 110 is transferred to the slave piston 120. The slave piston 120, in turn, transfers the motion through the rocker arm 310 to the engine valve 400.

Hydraulic fluid is also supplied to the valve seating device 200 through the passage 620. The fluid flows through the annulus 215 into the fluid slot 205. As discussed above, some of the fluid may leak into the lash chamber 207 and cause the upper surface 211 of the lash piston 210 to contact the third contact surface 303 of the rocker arm 310, taking up any system lash.

As motion is transferred from the lost motion system 100 to the rocker arm 310, the rocker arm 310 rotates in a clockwise direction and actuates the engine valve 400 at the first contact surface 301. As the rocker arm 310 rotates clockwise to open the engine valve 400, the third contact surface 303 on the rocker arm 310 may move away from the lash piston 210.

At this point, the fluid entering the fluid slot 205 through the annulus 215 may push down on the check disk 230 and up on the lash piston 210. The hydraulic pressure causes the lash piston 210 to move upwards, and the seating piston 220 to move downwards, separating the check disk 230 from its seat against the shoulder 212 and allowing fluid to enter the cavity 206. The seating piston 220 continues to move down until it hits the retaining ring 260. At this point, the hydraulic pressure below the check disk 230 and the bias of the spring 240 cause the check disk 230 to return to its seat against the shoulder 212, covering the fluid opening 208 and trapping fluid in the cavity 206. The valve seating device 200 is now charged, and ready to perform its seating function.

As the engine valve 400 closes, the rocker arm 310 may rotate counter-clockwise until the third contact surface 303 on the rocker arm 310 contacts the upper surface 211 of the lash piston 210. The lash piston 210 may then be forced downward, pressurizing the hydraulic fluid below it. The downward force of the lash piston 210 squeezes the area of the cavity 207, increasing the pressure in the cavity 207, and forcing the seating piston 220 upward. The upward motion of the seating piston 220 squeezes the area of the cavity 206, forcing fluid to flow through the bleed orifice 235. At the same time, the bias of the spring 250 forces the seating piston 220 upward within the cavity 206. Because of the relatively small size of the bleed orifice 235, the flow of fluid from the cavity 206 through the bleed orifice 235 creates a retarding force that slows the downward motion of the lash piston 210, and, in turn, the motion of the rocker arm 310, and, ultimately the seating velocity of the engine valve 400. The fluid exiting the cavity 206 may flow through the annulus 215 and the passage 620 to the control circuit 600.

The rate of fluid flow through the bleed orifice 235, and, correspondingly, the amount of retarding force created, is dependant on the flow area through the orifice. The flow area through the orifice is regulated by the proximity of the piston head 225 and the bleed orifice 235. When the rocker 310 first contacts the valve seating device 100, and the lash piston 210 begins to move downward, the distance between the piston head 225 and the bleed orifice 235, and, accordingly, the size of the flow area, is greatest. The high velocity of the closing engine valve creates a high flow rate through the bleed orifice 235 and a significant retarding force. As the valve slows and approaches its seat, the distance between the piston head 225 and the bleed orifice 235, and, thus, the flow area through the orifice, becomes progressively smaller. As a result of the lower seating velocity and the smaller flow area, a more constant retarding pressure is produced.

Figure 5:
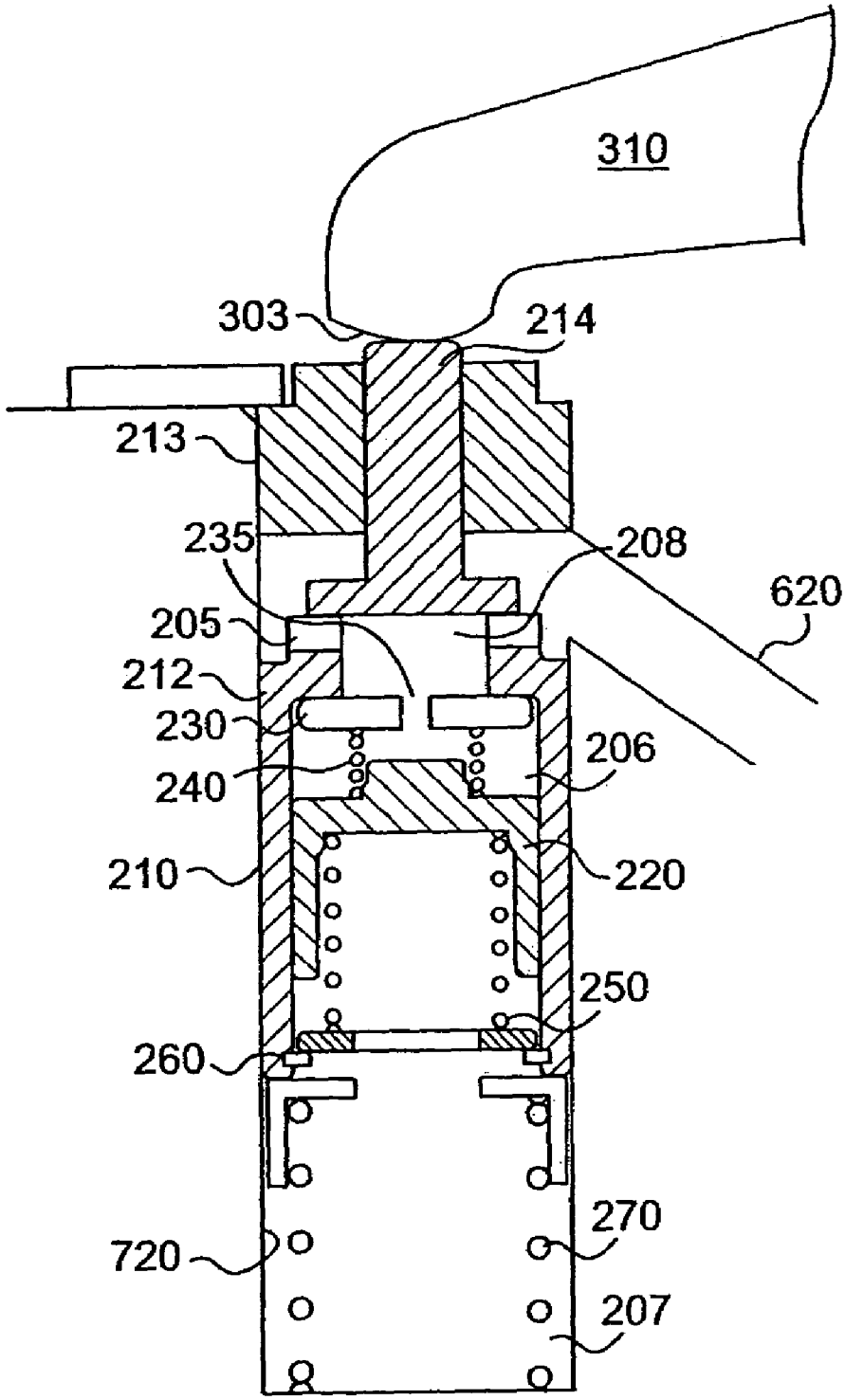
FIG. 5 is a cross-section detail view of a valve seating device in accordance with an embodiment of the present invention.

Another embodiment of the valve seating device 200 is shown with reference to FIG. 5, in which like reference characters refer to like elements. The valve seating device 200 may further comprise a stationary bushing member 213 disposed in the bore 720, and a contact pin 214 slidably disposed in the bushing member 213. In the position shown in FIG. 5, the contact pin 214 may have a first end in contact with the third contact surface 303 of the rocker arm 310 and a second end in contact with the lash piston 210. A spring 270 may bias the lash piston 210 and the seating piston 220 against the contact pin 214.

In one embodiment of the present invention, hydraulic fluid pressure below the pin 214 may act on the pin 214 such that the pin 214 remains in contact with the rocker arm 310 during the full rocker arm stroke. In this embodiment, there may be no impact between the pin 214 and the rocker arm 310. Correspondingly, the noise associated with the valve seating device 200 may be reduced. In an alternative embodiment, the pin 214 may have a limited stroke such that the pin 214 and the rocker arm 310 may separate during rotation of the rocker arm 310. The size and/or material composition of the pin 214 may be designed such that the impact force that occurs when the pin 214 and the rocker arm 310 reconnect is reduced.

Operation of the valve seating device 200 shown in FIG. 5 will now be described. Hydraulic fluid is supplied to the valve seating device 200 through the passage 620. The fluid flows into the fluid slot 205 underneath the pin 214. At this point, the fluid entering the fluid slot 205 may push up on the pin 214. Because the pin 214 has a diameter that is relatively small as compared with the diameter of the bore 720, the force acting on the rocker arm 310, and subsequent rocker arm rotation, due to the upward motion of the pin 214 may be reduced. As a result, unwanted force acting in the valve opening direction on a closed engine valve 400 is also reduced.

The bias of the spring 270 causes the lash piston 210 to move upward, contacting the pin 214 and removing the lash from the system. Fluid pressure acting on the pin 214 may bias the pin 214 such that it remains in contact with the rocker arm 310 during the full rocker arm stroke. As discussed above, in this embodiment, rocker-to-pin impact may be reduced or eliminated, which, in turn, may result in reduced noise during valve seating operation.

As the rocker arm 310 rotates in the valve opening direction, and the third contact surface 303 moves upward, the pin 214 also moves upward. This, in turn, allows the lash piston 210 to move upward. The upward motion of the lash piston 210 increases the volume of cavity 207, and correspondingly, decreases the pressure of the hydraulic fluid in the cavity 207. The reduced pressure in the cavity 207 and the pressure above the seating piston 220 causes the seating piston 220 to move downward. The seating piston 220 continues to move down until it hits the retaining ring 260, or a base for the spring 250 as shown in FIG. 5. At this point, the hydraulic pressure below the check disk 230 and the bias of the spring 240 cause the check disk 230 to return to its seat against the shoulder 212, covering the fluid opening 208 and trapping fluid in the cavity 206. The valve seating device 200 is now charged, and ready to perform its seating function.

As the engine valve 400 closes, the rocker arm 310 may rotate in the valve closing direction. The rotation of the rocker arm 310 forces the pin 214 downward, contacting the lash piston 210. Because the impact between the lash piston 210 and the pin 214 occurs in an oil-filled area above the slot 205 in the bore 720, some or all of the noise generated may be damped. The lash piston 210 may then be forced downward, pressurizing the hydraulic fluid below it. The downward force of the lash piston 210 squeezes the area of the cavity 207, increasing the hydraulic pressure in the cavity 207 and forcing the seating piston 220 upward. The upward motion of the seating piston 220 squeezes the area of cavity 206, forcing the fluid in the cavity 206 through the bleed orifice 235. At the same time, the bias of the spring 250 forces the seating piston 220 upward within the cavity 206. Because of the relatively small size of the bleed orifice 235, the flow of fluid from the cavity 206 through the bleed orifice 235 creates a retarding force that slows the downward motion of the lash piston 210, and, in turn, the motion of the rocker arm 310, and, ultimately the seating velocity of the engine valve 400. The fluid exiting the cavity 206 may flow through the annulus 215 and the passage 620 to the control circuit 600.

Figure 6:
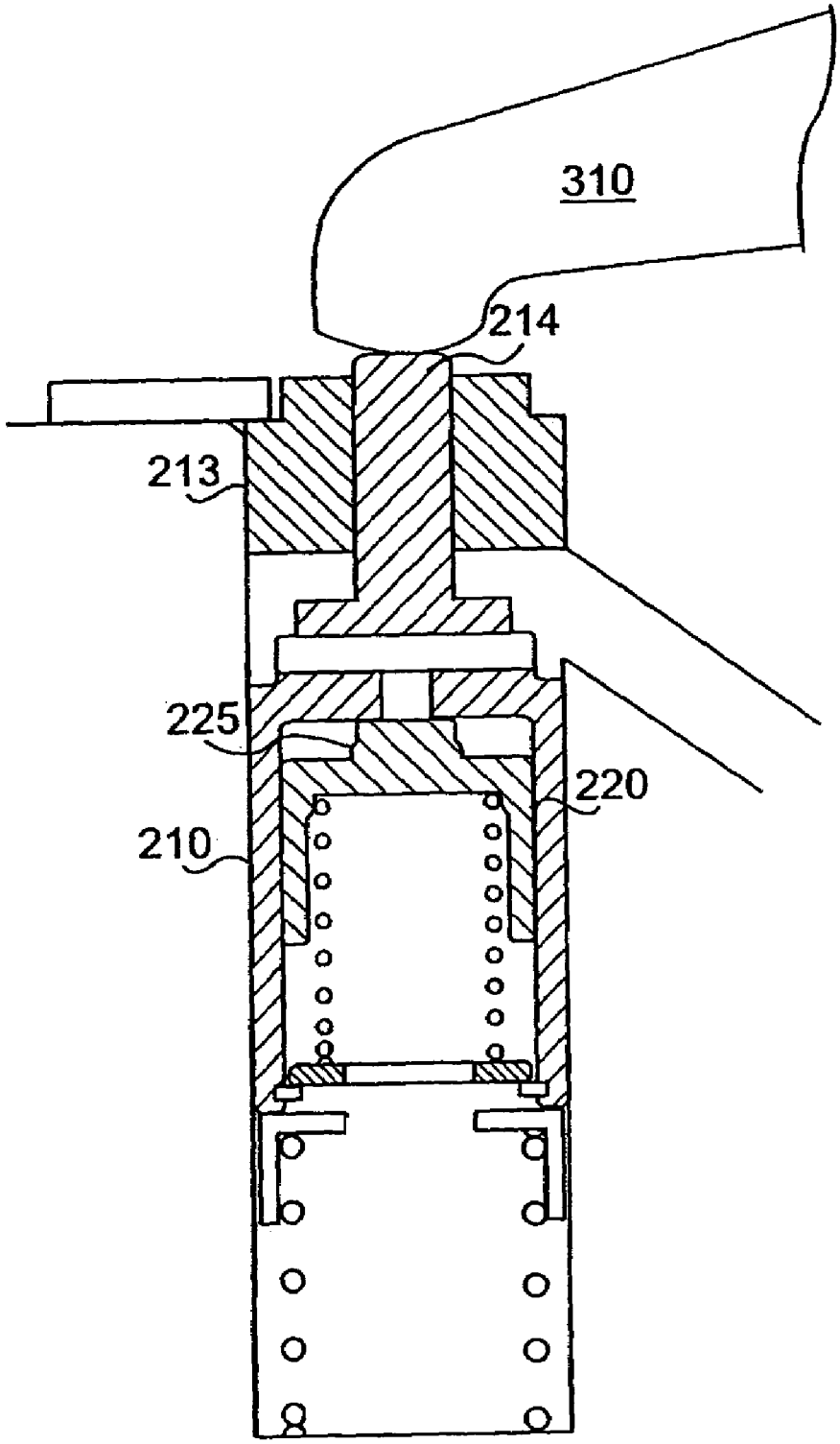
FIG. 6 is a cross-section detail view of a valve seating device in accordance with an embodiment of the present invention.

In another embodiment of the present invention, as shown in FIG. 6, the valve seating device 200 may operate without the check disk 235. The size of the fluid opening 208 may be reduced such that the piston head 225 substantially covers the opening 208. In this manner, the fluid opening 208 may operate like the bleed orifice 235 and provide the necessary valve seating retarding force.

In one embodiment of the present invention, the valve seating device 200 and the lost motion system 100 may be positioned so as to share the control circuit 600. An accumulator may be located between the valve seating device 200 and the lost motion system 100. The accumulator may absorb excess hydraulic fluid and re-supply such fluid to the valve seating device 200 and the lost motion system 100 as each system may require. However, it is appreciated that by positioning the lost motion system 100 near or adjacent to the valve seating device 200 many other advantages may be obtained. For example, the valve seating device 200 and the lost motion system 100 may be positioned so as to share fluid supply components and/or housings. Additionally, the overall weight of the valve seating control system 10 may be reduced.

It will be apparent to those skilled in the art that various modifications and variations can be made in the construction, configuration, and/or operation of the present invention without departing from the scope or spirit of the invention. For example, where lost motion functionality is not required, it is contemplated that embodiments of the valve seating device 200 may be provided in a system without the lost motion system 100.

What is claimed is:

1. A system for actuating at least one engine valve in an internal combustion engine with valve seating control, said system comprising:

a housing;

a lost motion system disposed in said housing;

a rocker arm having a first contact surface, a second contact surface, and a third contact surface, the first contact surface operatively contacting the engine valve, and the second contact surface operatively contacting said lost motion system; and a valve seating device disposed in said housing, operatively contacting the third contact surface, said valve seating device including at least two hydraulic elements which are displaced relative to each other and hydraulically pressurized during a valve seating event.

2. The system of claim 1, wherein said valve seating device hydraulic elements comprise:

a lash piston slidably disposed in a bore formed in said housing, said lash piston having a cavity formed therein; and a seating piston slidably disposed in the cavity.

3. The system of claim 2, further comprising a check disk disposed between said lash piston and said seating piston, said check disk having a bleed orifice formed therein.

4. The system of claim 3, further comprising a piston head extending from said seating piston.

5. The system of claim 4, wherein the distance between said piston head and said check disk regulates the flow of hydraulic fluid through the bleed orifice.

6. The system of claim 2, wherein said valve seating device further comprises:

a bushing member disposed in said housing above said lash piston; and a pin slidably disposed in said bushing member, said pin having a first end in contact with said lash piston and a second end in contact with said rocker arm.

7. The system of claim 6, further comprising a check disk disposed between said lash piston and said seating piston, said check disk having a bleed orifice formed therein.

8. The system of claim 6, further comprising:

a fluid opening formed in said lash piston; and a piston head extending from said seating piston, said piston head adapted to substantially cover said opening.

9. The system of claim 1, wherein said lost motion system comprises:

a master piston slidably disposed in a bore formed in said housing; and a slave piston slidably disposed in said master piston.

10. The system of claim 1, wherein the second contact surface is between the first and third contact surfaces.

11. The system of claim 1, wherein said lost motion system and said valve seating device are adapted to receive hydraulic fluid from a common fluid supply source.

12. The system of claim 1, wherein said valve seating device has a unique position when the engine valve is closed.

13. A system for controlling the seating velocity of an engine valve in an internal combustion engine, said system comprising:

a housing;

a lash piston slidably disposed in a bore formed in said housing, said lash piston having a cavity formed therein;

a seating piston slidably disposed in the cavity; and a check disk disposed between said lash piston and said seating piston, said check disk having a bleed orifice formed therein.

14. The system of claim 13, further comprising a piston head extending from said seating piston.

15. The system of claim 14, wherein the distance between said piston head and said check disk regulates the flow of hydraulic fluid through the bleed orifice.

16. The system of claim 13, further comprising:

a bushing member disposed in said housing above said lash piston; and a pin slidably disposed in said bushing member, said pin having a first end in contact with said lash piston and a second end in contact with said rocker arm.

17. The system of claim 16, further comprising a check disk disposed between said lash piston and said seating piston, said check disk having a bleed orifice formed therein.

18. The system of claim 16, further comprising:

a fluid opening formed in said lash piston; and a piston head extending from said seating piston, said piston head adapted to substantially cover said opening.

19. The system of claim 1, further comprising a means for imparting engine valve actuation motion to the lost motion system, said means for imparting motion being operatively connected to the lost motion system.

* * * * *